United States Patent [19]

Pollich

[11] Patent Number: 5,033,732

[45] Date of Patent: Jul. 23, 1991

[54] DEVICE FOR ALIGNING LEADING EDGES OF SHEETS

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 455,303

[22] Filed: Dec. 22, 1989

[30] Foreign Application Priority Data

Dec. 22, 1988 [DE] Fed. Rep. of Germany ..... 3843152

[51] Int. Cl.[5] ..... B65H 9/04

[52] U.S. Cl. ..... 271/245; 271/253

[58] Field of Search ..... 271/253, 245, 243, 226, 271/255, 246; 101/232, 279

[56] References Cited

U.S. PATENT DOCUMENTS 2,069,918 2/1937 Gegenheimer ..... 271/253
2,976,038 3/1961 Whyte ..... 271/253
3,682,472 8/1972 Barthel .
4,466,350 8/1984 Schilling .

FOREIGN PATENT DOCUMENTS 2052786 5/1972 Fed. Rep. of Germany .
3215804 11/1989 Fed. Rep. of Germany .
2170785 8/1986 United Kingdom .

*Primary Examiner*—David H. Bollinger
*Attorney, Agent, or Firm*—Herbert L. Lerner; Laurence A. Greenberg

[57] ABSTRACT

A device is provided for aligning leading edges of sheets at adjustable front lays of a feeder wherein the sheets are fed one after the other against the front lays in a conveying direction perpendicular to the leading edges, the front lays being connected to a front-lay shaft so as to be fixed against rotation relative thereto. The front-lay shaft is, in turn, mounted in a first and in a second bearing of the feeder. A swivelling device connected to the front-lay shaft reciprocatingly swivels the front lays about a longitudinal axis of the front-lay shaft. The aligning device includes a bending device for benging the front-lay axis by acting steadily on the front-lay shaft for selectively adjusting the longitudinal axis of the front-lay shaft so that the longitudinal axis has a shape which, respectively, is curved in the conveying direction, curved opposite the conveying direction and rectilinear.

9 Claims, 4 Drawing Sheets

DEVICE FOR ALIGNING LEADING EDGES OF SHEETS

The invention relates to a device for aligning leading edges of sheets and, more particularly, to such a device wherein the leading edges are at adjustable front lays of a feeder in which the sheets are fed one after the other against the front lays in a conveying direction perpendicular to the front edges, the front lays being connected to a front-lay shaft so as to be fixed against rotation relative thereto, the front-lay shaft, in turn, being mounted in a first and in a second bearing of the feeder, and including a swivelling device for reciprocatingly swivelling the front lays about a longitudinal axis of the front-lay shaft.

A measure intended to ensure in-register printing of sheets is that the front edges of sheets to be printed are aligned in a feeder which precedes a printing unit. For this purpose, use is made in the prior art of adjustable front lays.

Adjustable front lays have become known heretofore, for example, from German Published Prosecuted Patent Application (DE-C2) 32 15 804. In a first represented embodiment disclosed therein, each individual front lay of a plurality of front lays distributed over a front-lay shaft is adjustable by means of an adjusting screw in and opposite to the sheet conveying direction relative to a respective front-lay holder which is clamped to the front-lay shaft. To be sure, this provides the possibility, amongst other things, of adjusting the front lays to any selected or required curvature of the leading edges of the sheets and thus of achieving a trouble-free contact thereof with the front lays in order to align the sheets in the conveying direction. Such individual adjustment of each individual front lay is extremely laborious and time-consuming, however.

In another device for adjusting front lays described in the aforementioned publication, the front-lay shaft is mounted in eccentric bearings, which are appropriately turned prior to the start of printing in order to define the stop of the sheets. This, however, merely makes it possible to take into account any deviation from the perpendicular to the conveying direction in an otherwise straight leading edge.

From German Published Non-Prosecuted Application (DE-A1) 35 04 435, a device has become known by means of which a leading edge of a sheet which has been aligned at a feeder is deformable by a feed cylinder after a sheet has been transferred to the feed cylinder. For this purpose, the feed cylinder is equipped with a register bar provided with stops, the register bar being deformable out of its normally straight or rectilinear configuration into a curved configuration by means of adjusting screws. The straight leading sheet edge is fed to the stops at a speed which is greater than the circumferential speed of the feed cylinder so that the leading end of the sheet arches or bulges at the stops, and the leading edge of the sheet fully abuts each of the stops and is deformed in accordance with the curvature of the register bar when the sheet becomes wrapped around the feed cylinder. The deformation of the leading edge of the sheet is thereby supposed to counteract defects which may occur during offset printing, especially, and which may be caused by deformation of a sheet due to the effect of dampening medium thereon, when the sheet is passing through a printing unit. The requirement to be met by a feeder, namely to align sheets having leading edges which have become curved beforehand, is not satisfied, however, by this heretofore known device.

It is accordingly an object of the invention to provide a device of the foregoing general type wherein the front lays are adjustable to a curvature of the leading edges of the sheets without requiring elaborate measures for adjusting the front lays.

With the foregoing and other objects in view, there is provided, in accordance with the invention, a device for aligning leading edges of sheets at adjustable front lays of a feeder wherein the sheets are fed one after the other against the front lays in a conveying direction perpendicular to the leading edges, the front lays being connected to a front-lay shaft so as to be fixed against rotation relative thereto, the front-lay shaft, in turn, being mounted in a first and in a second bearing of the feeder, and including a swivelling device for reciprocatingly swivelling the front lays about a longitudinal axis of the front-lay shaft, comprising a bending device acting steadily on the front-lay shaft for selectively adjusting the longitudinal axis of the front-lay shaft so that the longitudinal axis has a shape which, respectively, is curved in the conveying direction, curved opposite the conveying direction and rectilinear.

In accordance with another view, the invention calls for a device for aligning leading edges of sheets at adjustable front lays of a feeder wherein the sheets are fed successively against the front lays in a conveying direction perpendicular to the leading edges, the front lays being rigidly connected to a front-lay shaft, and including a swivelling device for swivelling the front lays about a longitudinal axis of the front-lay shaft, comprising a bending device including bearing means disposed at an intermediate location of the front-lay shaft and being selectively movable into displaced positions with respect to a mid-position of the front-lay shaft wherein the longitudinal axis of the front-lay shaft is rectilinear, the longitudinal axis in the displaced positions of the bearing means being respectively curved in and opposite to the conveying direction.

The aligning device according to the invention may be used to particular advantage in cases where piles of sheets are to be processed in a printing press, the sheets having edges formed with convex or concave curvature, depending upon the previous history thereof, which are to come into contact with the front lays.

It is also possible, with the aligning device according to the invention, for example, to process piles of sheets advantageously, which have edges that have assumed a convex curvature due to storage of the sheets in excessively dry rooms or edges that have assumed a concave curvature due to storage of the sheets in excessively damp rooms.

Although aligning devices have become known heretofore wherein allowance is made for swelling of freshly printed sheets, the bending devices used in this regard, however, operate periodically in phase with a printing press and deform the leading edges of the sheets after the subsequent closing of grippers, by means of which the sheets are transported until they are transferred to following grippers. Depending upon their construction, the bending devices heretofore used for this purpose effect either common displacements of gripper supports and appertaining gripper fingers, or merely displacements of gripper supports and, in the latter case, roughly finished surfaces of the gripper supports ensure displacements of the sheets with respect to corresponding gripper fingers (U.S. Pat. No. 4,466,350; German Published Non-Prosecuted Application DE-OS 20 52 786). Such heretoforeknown devices are used in order to counteract the so-called fanning-out of the sheets as they pass through a printing unit.

Bending devices of the foregoing type, however, are not suitable for devices for aligning leading edges of sheets at adjustable front lays, because the leading edges which are to be deformed by such bending devices must first be aligned at front lays before being deformed. On the contrary, the conventional bending devices, which act at the leading edges of the sheets, are able to effect only adjustments of gripper systems in which previously aligned sheets are available. But this is where the invention of the instant application comes into play and opens up the possibility of aligning sheets with curved leading edges without requiring elaborate measures for adjustment of the front lays, and making the sheets ready for transfer to a gripper system.

In contrast with the elaborate method of individual adjustment of each individual front lay, the invention of the instant application affords a simultaneous adjustment of all front lays to the curvature of leading edges of sheets which are to be processed.

In accordance with a further feature of the invention, the bending device comprises a third bearing disposed at a location substantially in the middle between the first bearing and the second bearing and carrying the front-lay shaft, the third bearing being movable into displaced positions with respect to a mid-position thereof wherein the longitudinal axis of the front-lay shaft is rectilinear, the bending device comprising the bearing lever, the cross-member and adjusting means connecting the bearing and the cross-member at a selective spacing from one another.

The diminishing effort or expense required by the invention for adjusting all of the front lays to the curvature of leading edges of sheets is thus reduced to an adjusting movement of the third bearing.

In accordance with another, more detailed feature, the aligning device comprises a first swivelling part supporting the first bearing; a first articulating joint connecting the first swivelling part to a supporting part; a second swivelling part supporting the second bearing; a second articulating joint connecting the second swivelling part to the supporting part; a bearing lever supporting the third bearing; a third articulating joint connecting the third bearing to the supporting part; the first, second and third articulating joints having a common horizontal, fixed geometrical swivelling axis extending transversely to the conveying direction; swivel means for setting the first and second swivelling parts into selective swivel positions with respect to the common geometrical swivelling axis; a cross-member connected to the bearing lever; respective fourth bearings rotatably mounting the cross-member in each of the first and second swivelling parts; the first to the fourth bearings and the first to the third articulating joints being constructed so that the longitudinal axis of the front-lay shaft is adjustable at an angle to the common geometrical swivelling axis; the bending device comprising the bearing lever, the cross-member and adjusting means connecting the bearing and the cross-member to one another; the bearing lever being articulatingly connected to the supporting part; the cross-member being mounted in the first and second swivelling parts; and the adjusting means being constructed so as to set the bearing lever and the cross-member at a selective spacing from one another.

This embodiment is particularly advantageous inasmuch as it permits adjustment, with little effort, of all of the front lays to the curvature of leading edges of sheets even when an obliquely or inclinably adjustable front-lay shaft is provided in order to match a leading edge which is additionally inclined. In this regard, apart from the reduced expense required for adjustment, it is also possible to minimize the constructive expense by providing, in accordance with additional features of the invention, adjusting means comprising spring-loaded tensioning means having a tendency to reduce the spacing of the bearing lever and the cross-member from one another, and a stop counteracting the tensioning means and adjustable with respect to the cross-member.

In accordance with additional and more detailed features of the invention, the spring-loaded tensioning means comprise tie-rods transversely passing through the cross-member and having an articulated connection with the bearing lever, the articulated connection being disposed on one side of the cross-member between the third bearing and the third articulating joint; each of the tie-rods having a stem projecting out of the cross-member on the other side of the cross-member and a compression spring clamped between the cross-member, and a shoulder formed at an end of the stem, the stop being formed of an adjusting screw screwed into and transversely passing through the cross-member.

The third bearing also reduces bending vibrations of the front-lay shaft which may possibly be caused by the swivelling device engaging the front-lay shaft. In accordance with yet another feature of the invention, the swivelling device engages the front-lay shaft in immediate vicinity of the third bearing.

The desirable effect with respect to the reduction in torsional and bending vibrations, which can be caused in the front-lay shaft due to the swivelling device in engagement therewith is exhibited in accordance with yet a further feature of the invention, wherein the bending device comprises a pair of spaced-apart third bearings wherein the front-lay shaft is mounted; the third bearings being symmetrically disposed with respect to the first bearing and the second bearing; and respective adjusting means for moving the third bearings into displaced positions with respect to a mid-position thereof wherein the shape of the longitudinal axis of the front-lay shaft is rectilinear; the swivelling device engaging the front-lay shaft substantially midwise between the first bearing and the second bearing.

Such a device proves to be user-friendly in accordance with a concomitant feature of the invention, wherein the aligning device includes a connecting link connecting the respective adjusting means to one another for effecting a common adjustment.

Other features which are considered as characteristic for the invention are set forth in the appended claims.

Although the invention is illustrated and described herein as embodied in a device for aligning leading edges of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
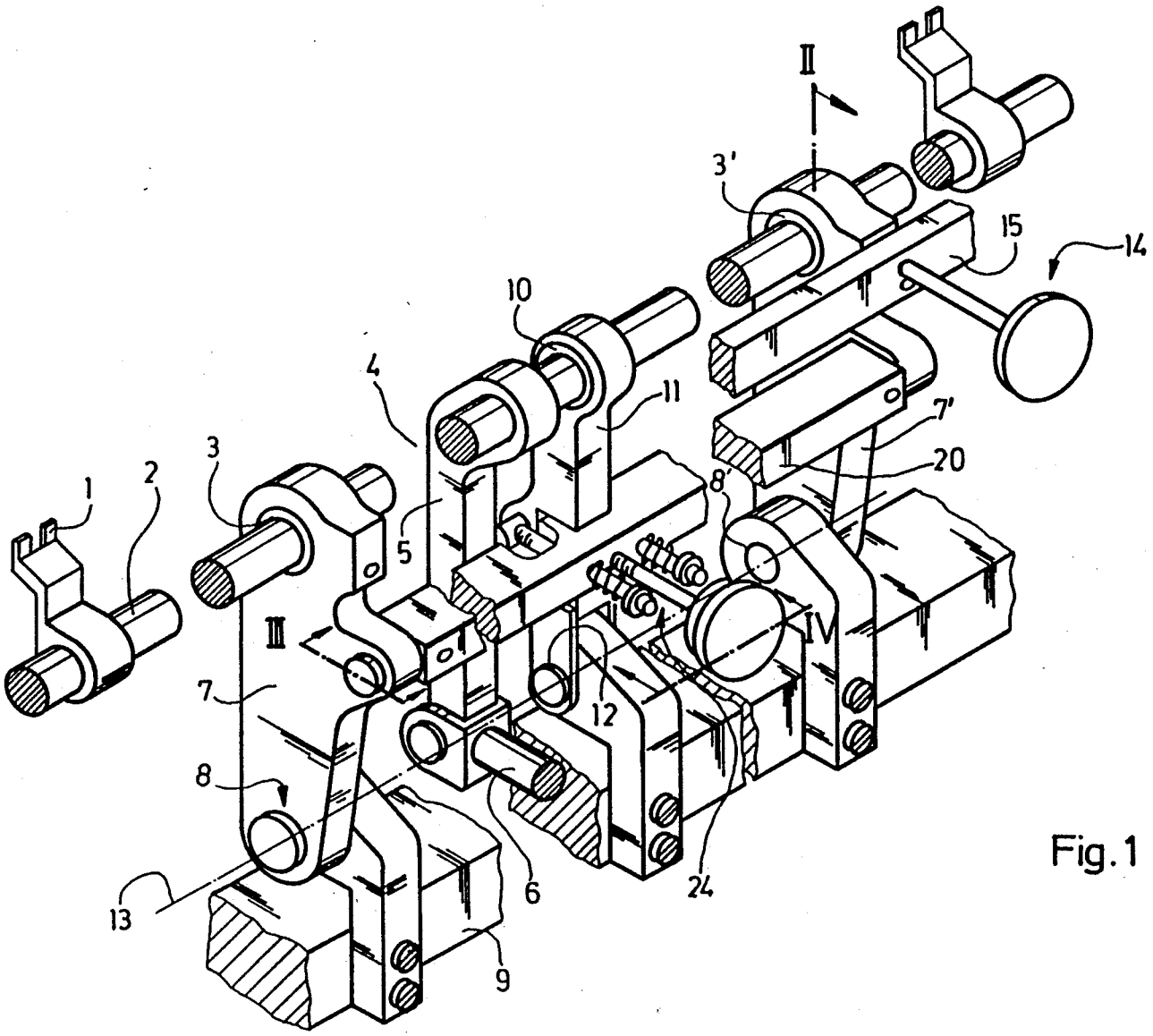
FIG. 1 is a simplified perspective view, partly in section and partly broken away, of a first embodiment of a device for aligning leading edges of sheets in accordance with the invention.

Referring now to the drawing and, first, particularly to FIG. 1 thereof, there is provided therein a device for aligning leading edges of sheets wherein sheets are fed successively in a conveying direction perpendicular to the leading edges thereof, to front lays 1. The feeding device necessary for this purpose is not a constituent part of the invention and is, therefore, not illustrated or described in detail. The sheets are likewise not shown. Of the front lays 1, which are connected to a front-lay shaft 2 so as to be fixed against rotation relative thereto and which are distributed over the length of the latter, only two are shown in FIG. 1 in order to simplify the representation.

The front-lay shaft 2 is rotatably mounted in a first bearing 3 and a second bearing 3' and is connected to a swivelling device 4 for reciprocatingly swivelling the front-lay shaft 2 about its longitudinal axis. The swivelling device 4 is not a constituent part of the invention and is represented in FIG. 1, merely by way of example, as a rocker lever 5 connected to the front-lay shaft 2 so as to be fixed against rotation relative thereto, and having a crank or connecting rod 6 of an otherwise non-illustrated crank drive swivel-connected thereto.

The first bearing 3 is borne by a first swivelling part 7, and the second bearing 3' by a second swivelling part 7'. The two swivelling parts 7 and 7' are connected by a first articulating joint 8 and a second articulating joint 8', respectively, to a stationary supporting part 9 having ends which are attached to sidewalls likewise non-illustrated.

Provided substantially in the middle between the first bearing 3 and the second bearing 3' is a third bearing 10 supporting the front-lay shaft 2, and a bearing lever 11 carrying the third bearing 10 is connected to the supporting part 9 by means of a third articulating joint 12. The first, second and third articulating joints 8, 8' and 12 are located at lower ends of the two swivelling parts 7 and 7' and the bearing lever 11, respectively, and are disposed so that the first, second and third articulating joints 8, 8' and 12 have a common fixed geometrical swivel axis 13, which extends horizontally, whereas the first and second bearings 3 and 3' are disposed at upper ends of the swivelling parts 7 and 7', respectively, and the third bearing 10 is disposed at the upper end of the bearing lever 11. Furthermore, the geometrical swivel axis 13 extends transversely to the conveying direction. Thus, the front-lay shaft 2 is able to execute a swivelling motion in and opposite to the conveying direction with respect to the geometrical swivel axis 13.

The swivelling device 4 provided for swivelling the front-lay shaft 2 about the longitudinal axis of the latter engages the front-lay shaft 2 in the immediate vicinity of the third bearing 10.

With the aid of swivelling means 14, each of the two swivelling parts 7 and 7' is able to be brought into a selective swivel position. Another supporting part 15 located opposite the upper ends of the swivelling parts 7 and 7' is provided for this purpose. The supporting part 15 is, in turn, attached at its ends to the non-illustrated side-walls. In the interest of simplicity, there are shown in FIG. 1 only a portion of the supporting part 15 located opposite the swivelling part 7' at the right-hand side of the figure, and the adjusting means 14, which act upon the swivelling part 7'. Although not illustrated in FIG. 1, a similar adjusting means acts upon the swivelling part 7.

Figure 2:
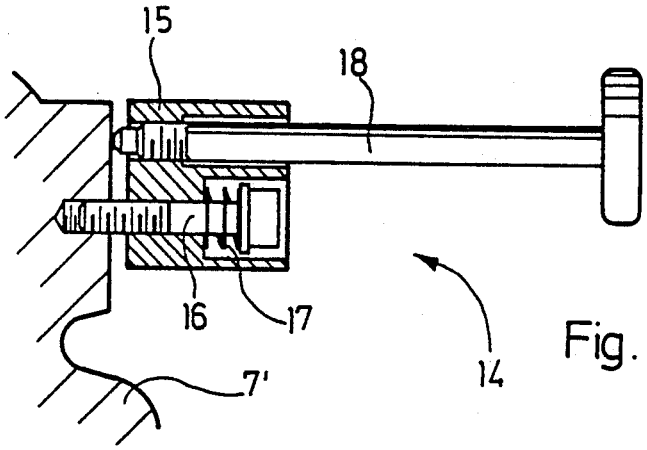
FIG. 2 is an enlarged fragmentary sectional view of FIG. 1 taken along the line II in the direction of the arrows.

An embodiment of the swivelling means 14 is shown in detail in FIG. 2. In this regard, a respective clamping screw 16 passing through the supporting part 15 is screwed into an upper end of a respective swivelling part 7' or 7. A spring 17, which is clamped under a screw head of the clamping screw 16 and is braced against the supporting part 15, presses the respective swivelling part 7' and 7, respectively, in a direction towards the supporting part 15 against an adjustable stop formed by an adjusting spindle 18 which is threadedly secured in the supporting part 15.

Figure 3:
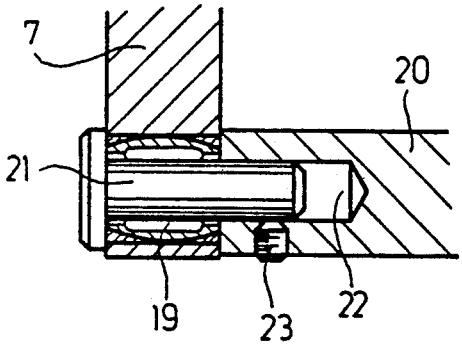
FIG. 3 is an enlarged fragmentary sectional view of FIG. 1 taken along the line III in the direction of the arrows.

By means of a respective fourth bearing 19 (FIG. 3), a cross-member or traverse 20 is rotatably mounted by its ends in swivelling parts 7 and 7', respectively. A preferred embodiment for mounting the cross-member 20 is shown in FIG. 3, in which the fourth bearing 19 is inserted in the swivelling parts 7 and 7', respectively. A respective pin 21 is inserted into the bearing 19 so as to fit into a respective hole 22 formed in the end face of the cross-member 20 and is locked in position with respect to the cross-member 20 by means of a locking screw 23.

Like the fourth bearing 19, the first, second and third bearings 3, 3' and 10 as well as the first, second and third articulating joints 8, 8' and 12, respectively, are likewise of such construction that the longitudinal axis of the front-lay shaft 2 is adjustable at an angle to the common geometrical swivel by the swivelling means 14. The front-lay shaft can be positioned at an angle or at an inclination to the swivel axis 13 by different adjustments of the two adjusting spindles 18 (only one of which, though unidentified, is shown in FIG. 1). Simultaneously with the inclined positioning of the front-lay shaft 2, an inclined positioning of the cross-member 20 also occurs because it is mounted in the swivelling parts 7 and 7', and the bearing lever 11, which is connected to the cross-member 20, swivels as well.

The bending device which acts upon the front-lay shaft 2, in accordance with the invention, includes the bearing lever 11 which is connected to the supporting part 9, and adjusting means 24, which, as explained further hereinbelow, on the first hand, connect the bearing lever 11 and the cross-member 20 to one another and, by means of which, on the other hand, it is possible to set a selective distance or spacing 25 (FIG. 4) between the bearing lever 11 and the cross-member 20.

Due to the connection of the bearing lever 11 to the cross-member 20 at a selective spacing 25, it is possible to move the third bearing 10, with respect to a central position in which the front-lay shaft 2 has a rectilinear longitudinal axis, into displaced positions in which the front lays 1 connected to the front-lay shaft 2 are able to match the curvature of a leading edge of a sheet. By suitable selection of the spacing 25, it is possible to adjust or set the longitudinal axis of the front-lay shaft 2 so that it is rectilinear and to adjust or set the longitudinal axis so that it is curved in or opposite to the conveying direction. For a given curvature of the leading edge of the sheets, the spacing 25 suitably selected therefor is maintained, so that the bending device acts in a fixed or stationary manner on the front-lay shaft 2.

Figure 4:
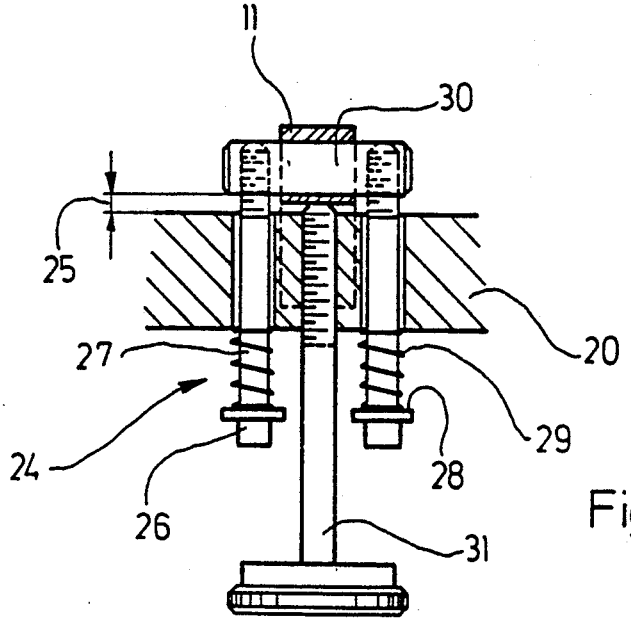
FIG. 4 is an enlarged fragmentary sectional view of FIG. 1 taken along the line IV in the direction of the arrows.

FIG. 4 shows, in a more clearly recognizable manner, the hereinafter further described adjusting means which were generally identified by the reference numeral 24 in FIG. 1. A part of the adjusting means 24 which connects the cross-member 20 and the bearing lever 11 to one another is formed of spring-loaded tensioning means, which tend to reduce the spacing 25. These tensioning means are formed of tie rods 26, which pass through the cross-member 20 transversely from one to the other side thereof and are articulatingly connected to the bearing lever 11 on the other side of the cross-member 20 between the third bearing 10 and the third articulating joint 12, each of the rods 26 having a stem 27 projecting out of the cross-member 20 on the one side thereof as well as a compression spring 29 clamped between a shoulder 28 at the end of each stem 27 and the cross-member 20. To effect an articulating connection between the tie rods 26 and the bearing lever 11, the tie rods 26 are screwed transversely into free ends of a hinge pin 30 which, in turn, transversely passes through the bearing lever 11. A part of the adjusting means 24 which determines the spacing 25 counteracts the spring-loaded tensioning means 26 and 30 and is made up of a stop in the form of an adjusting screw 31 screwed into the cross-member 20 and being adjustable with respect thereto.

Thus, with this embodiment, it is possible, even when there is a curvature of the front edges of the sheets, to adjust simultaneously all of the front lays by actuating a single adjusting element in the form of the adjusting screw 31. Such a procedure is possible even if it is additionally necessary to position the front-lay shaft 2 at an angle or inclination.

Figure 5:
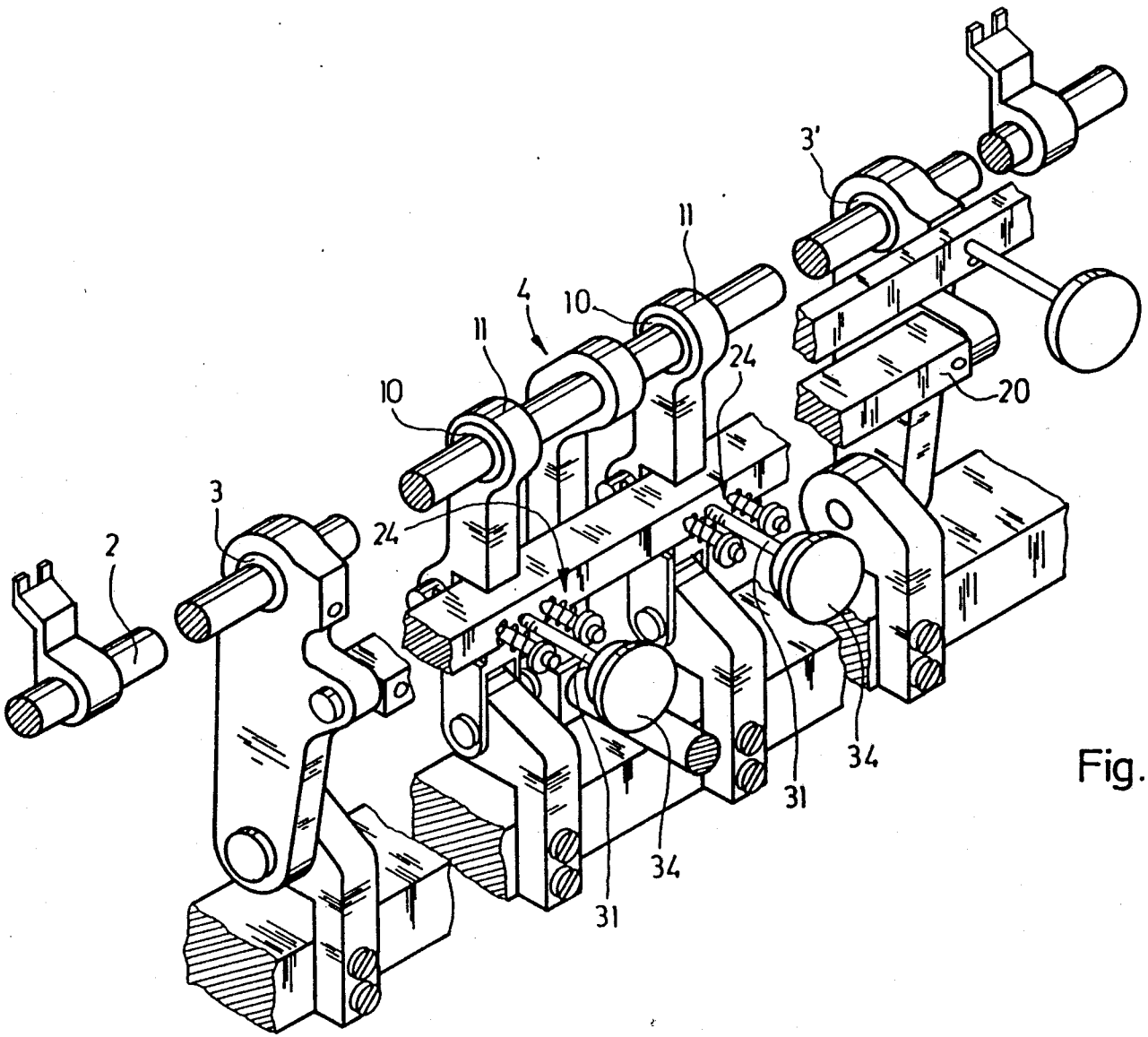
FIG. 5 is a simplified perspective view, partly in section and partly broken away of a second embodiment of the device according to the invention which includes a bending device formed of a pair of spaced-apart third bearings.
Figure 6:
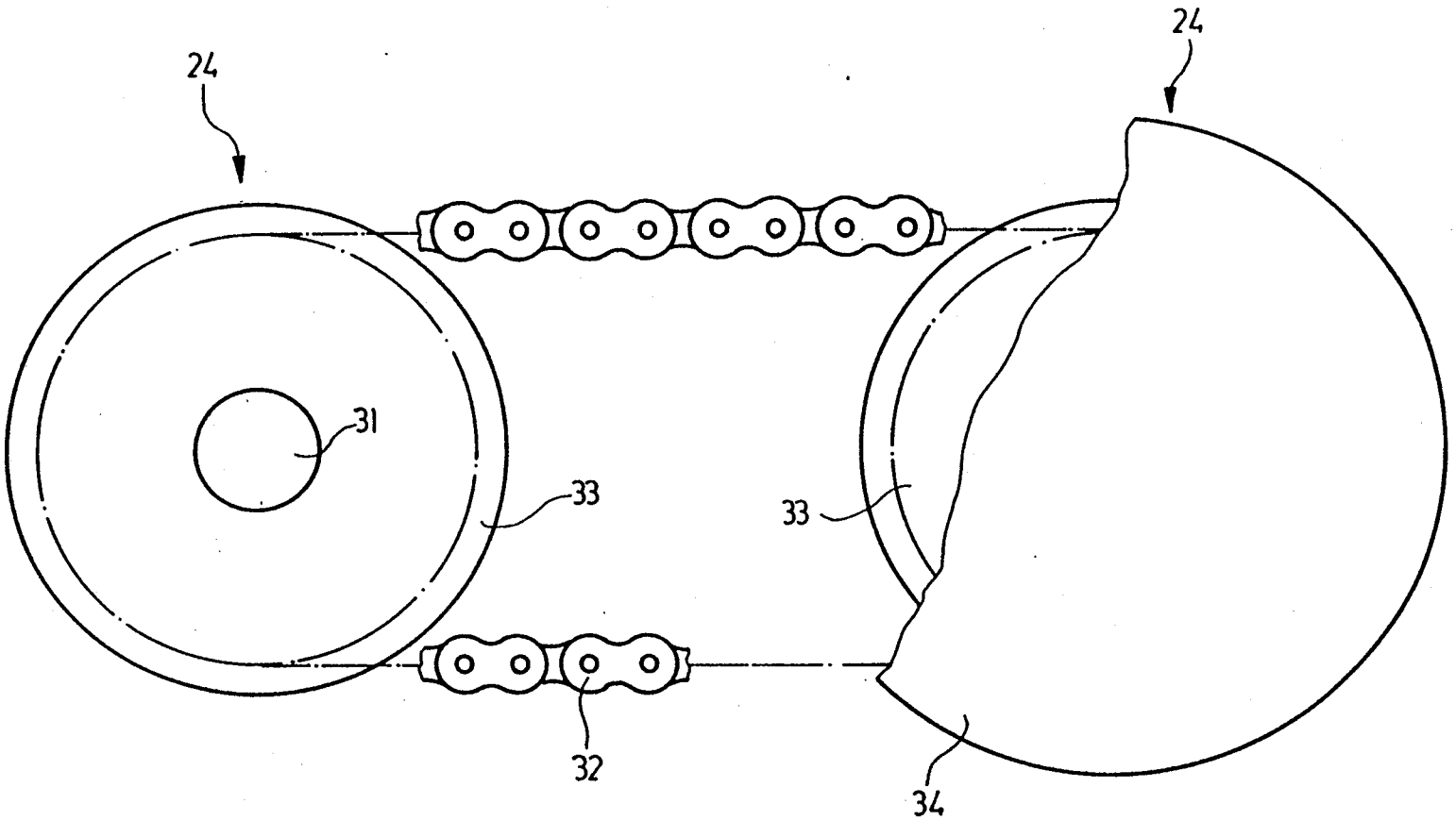
FIG. 6 is a much-enlarged fragmentary view of a pair of adjusting members according to FIG. 5 which are modified in that they are connected to a connecting link for common adjustment.

A second embodiment of the invention shown in FIG. 5 differs from that shown in FIG. 1 by the fact that, instead of one single bearing lever 11, two bearing levers 11 are provided, each of which carries a third bearing 10 for holding or mounting the front-lay shaft 2. The mutually spaced-apart third bearings 10 are disposed symmetrically with respect to the first bearing 3 and the second bearing 3'. The two bearing levers 11 are connected to the cross-member 20 in the same manner as shown in FIG. 1 and FIG. 4, respectively. In this embodiment, the swivelling device 4 engages the front-lay shaft 2 at a substantially middle location thereof between the first bearing 3 and the second bearing 3'. As shown in FIG. 6, the respective adjusting screws 31 of the respective adjusting means 24 in the embodiment according to FIG. 5, may be connected to one another by means of a connecting link 32 for common adjustment. Thus, with this embodiment as well, it is possible simultaneously to adjust all of the front lays, even when there is a curvature of the front edges of the sheets, by actuating a single adjusting element, namely the adjusting screw 31. In this case also, such a procedure is possible even if it is additionally necessary to position the front-lay shaft 2 at an angle or inclination.

In the embodiment shown in FIG. 6 wherein the two adjusting means 24 are connected to one another, each adjusting screw 31 is connected to a chain wheel 33 so as to be fixed against relative rotation therewith. The connecting link or member 32 is represented by a link chain slung around respective chain wheels or sprockets 33.

As shown in FIG. 6, the adjusting means 24 located at the right-hand side of the figure is provided with a suitable handwheel 34 for effecting a manual adjustment thereof.

In this connection, it is also possible for the adjusting means 24 shown at the left-hand side of FIG. 6 to be provided with an adjusting screw 31 without any handwheel. The foregoing is a description corresponding in substance to German Application P 38 43 152.1, dated December 22, 1988, the International priority of which is being claimed for the instant application, and which is hereby made part of this application. Any material discrepancies between the foregoing specification and the aforementioned corresponding German application are to be resolved in favor of the latter.

I claim:

1. In a device for aligning leading edges of sheets at adjustable front lays of a feeder wherein the sheets are fed one after the other against the front lays in a conveying direction perpendicular to the leading edges, the front lays being connected to a front-lay shaft so as to be fixed against rotation relative thereto, the front-lay shaft, in turn, being mounted in a first and in a second bearing of the feeder, and wherein a swivelling device is disposed for reciprocatingly swivelling the front lays about a longitudinal axis of the front-lay shaft, the improvement therein comprising a bending device for bending the front-lay shaft, said bending device being in engagement with the front-lay shaft for selectively adjusting the longitudinal axis of the front-lay shaft so that the longitudinal axis has a shape which, respectively, is curved in the conveying direction, curved opposite the conveying direction and rectilinear.

2. Aligning device according to claim 1, wherein said bending device comprises a third bearing disposed at a location on the longitudinal axis of the front-lay shaft substantially in the middle between the first bearing and the second bearing and carrying the front-lay shaft, said third bearing being movable transversely to the longitudinal axis of the front-lay shaft into displaced positions with respect to a mid-position thereof wherein the longitudinal axis of the front-lay shaft is rectilinear.

3. Aligning device according to claim 2 comprising a first swivelling part supporting the first bearing; a first articulating joint connecting said first swivelling part to a supporting part; a second swivelling part supporting the second bearing; a second articulating joint connecting said second swivelling part to said supporting part; a bearing lever supporting said third bearing; a third articulating joint connecting said third bearing to said supporting part; said first, second and third articulating joints having a common horizontal, fixed geometrical swivelling axis extending transversely to the conveying direction; swivel means for setting said first and second swivelling parts into selective swivel positions with respect to said common geometrical swivelling axis; a cross-member connected to said bearing lever; respective fourth bearings rotatably mounting said cross-member in each of said first and second swivelling parts; the first to the fourth bearings and said first to said third articulating joints having means or adjusting the longitudinal axis of the front-lay shaft at an angle to said common geometrical swivelling axis; said bending device comprising said bearing lever, said cross-member and an adjusting device connecting said bearing lever and said cross-member to one another; said bearing lever being articulatingly connected to said supporting part; said cross-member being mounted in said first and second swivelling parts; and said adjusting device having means for setting said bearing lever and said cross-member at a selective spacing from one another.

4. Aligning device according to claim 3, wherein said adjusting device comprises spring-loaded tensioning means having a tendency to reduce said spacing of said bearing lever and said cross-member from one another, and a stop counteracting said tensioning means and adjustable with respect to said cross-member.

5. Aligning device according to claim 4, wherein said spring-loaded tensioning means comprise tie-rods transversely passing through said cross-member and having an articulated connection with said bearing lever, said articulated connection being disposed on one side of said cross-member between said third bearing and said third articulating joint, each of said tie-rods having a stem projecting out of said cross-member on the other side of said cross-member, and a compression spring clamped between said cross-member and a shoulder formed at an end of said stem, said stop being formed of an adjusting screw screwed into and transversely passing through said cross-member.

6. Aligning device according to claim 2, wherein the swivelling device engages the front-lay shaft in immediate vicinity of said third bearing.

7. Aligning device according to claim 1, wherein said ending device comprises a pair of spaced-apart third bearings wherein the front-lay shaft is mounted; said third bearings being symmetrically disposed with respect to the first bearing and the second bearing on the longitudinal axis of the front-lay shaft; and respective adjusting means for moving said third bearings transversely to the longitudinal axis of the front-lay shaft into displaced positions with respect to a mid-position thereof wherein the shape of the longitudinal axis of the front-lay shaft is rectilinear; said swivelling device engaging the front-lay shaft substantially midwise between the first bearing and the second bearing.

8. Aligning device according to claim 7, including a connecting link connecting the respective adjusting means to one another for effecting a common adjustment.

9. Device for aligning leading edges of sheets at adjustable front lays of a feeder wherein the sheets are fed successively against the front lays in a conveying direction perpendicular to the leading edges, the front lays being rigidly connected to a front-lay shaft, and including a swivelling device for swivelling the front-lay shaft together with the front lays about a longitudinal axis of the front-lay shaft, comprising a bending device for bending the front-lay shaft, said bending device including bearing means disposed at an intermediate location on the longitudinal axis of the front-lay shaft and being selectively movable transversely to the longitudinal axis of the front-lay shaft into displaced positions with respect to a mid-position of the front-lay shaft wherein the longitudinal axis of the front-lay shaft is rectilinear, the longitudinal axis in said displaced positions of said bearing means being respectively curved in and opposite to the conveying direction.

* * * * *